US007891421B2

(12) United States Patent
Kasevich

(10) Patent No.: US 7,891,421 B2
(45) Date of Patent: Feb. 22, 2011

(54) METHOD AND APPARATUS FOR IN-SITU RADIOFREQUENCY HEATING

(75) Inventor: Raymond S. Kasevich, Mount Washington, MA (US)

(73) Assignee: JR Technologies LLC, Mount Washington, MA (US)

( * ) Notice: Subject to any disclaimer, the term of this patent is extended or adjusted under 35 U.S.C. 154(b) by 0 days.

(21) Appl. No.: 12/626,137

(22) Filed: Nov. 25, 2009

(65) Prior Publication Data

US 2010/0065265 A1 Mar. 18, 2010

Related U.S. Application Data

(63) Continuation of application No. 12/259,828, filed on Oct. 28, 2008, now abandoned, which is a continuation-in-part of application No. 11/471,276, filed on Jun. 20, 2006, now Pat. No. 7,441,597.

(60) Provisional application No. 60/692,112, filed on Jun. 20, 2005.

(51) Int. Cl.
*E21B 43/00* (2006.01)
*E21B 36/00* (2006.01)

(52) U.S. Cl. ..... 166/247; 166/249; 166/177.1; 166/248; 166/57

(58) Field of Classification Search ..... 166/272.1, 166/249, 177.2, 177.1, 177.6, 247, 248, 302, 166/369, 57
See application file for complete search history.

(56) References Cited

U.S. PATENT DOCUMENTS

| | | | | |
|---|---|---|---|---|
| 2,757,738 A | | 8/1956 | Ritchey | |
| 3,522,848 A | | 8/1970 | New | |
| 4,008,762 A | | 2/1977 | Fisher | |
| 4,470,459 A | | 9/1984 | Copland | |
| 4,583,589 A | * | 4/1986 | Kasevich | 166/60 |
| 5,065,819 A | * | 11/1991 | Kasevich | 166/248 |
| 5,082,054 A | | 1/1992 | Kiamanesh | |
| 6,189,611 B1 | | 2/2001 | Kasevich | |
| 7,562,708 B2 | | 7/2009 | Cogliandro et al. | |

FOREIGN PATENT DOCUMENTS

| | | |
|---|---|---|
| WO | WO99/30002 | 6/1999 |
| WO | WO00/57021 | 9/2000 |

* cited by examiner

*Primary Examiner*—Daniel P Stephenson
*Assistant Examiner*—Yong-Suk Ro
(74) *Attorney, Agent, or Firm*—Occhiuti Rohlicek & Tsao LLP

(57) ABSTRACT

A radiofrequency reactor for use in thermally recovering oil and related materials includes a radiofrequency antenna configured to be positioned within a well, where the well is provided within an area in which crude oil exists in the ground. The radiofrequency antenna includes a cylindrically-shaped radiating element for radiating radiofrequency energy into the area in which crude oil exists. The cylindrically-shaped radiating element is configured to allow passage of fluids there through. The radiofrequency reactor also includes a radiofrequency generator electrically coupled to the radiofrequency antenna. The radiofrequency reactor is operable to control the radiofrequency energy generated.

14 Claims, 6 Drawing Sheets

METHOD AND APPARATUS FOR IN-SITU RADIOFREQUENCY HEATING

CROSS-REFERENCE TO RELATED APPLICATION(S)

This application claims priority from U.S. provisional patent application No. 60/692,112, which was filed on Jun. 20, 2005, and which is incorporated herein by reference in its entirety. This application is a continuation of, and claims priority to, U.S. application Ser. No. 12/259,828, filed Oct. 28, 2008, which is a continuation-in-part application of, and claims priority to, U.S. application Ser. No. 11/471,276, filed Jun. 20, 2006, and now allowed, and which is incorporated herein by reference in its entirety.

FIELD OF THE INVENTION

The present invention relates generally to the use of radiofrequency energy to heat heavy crude oil or both heavy crude oil and subsurface water in situ, thereby enhancing the recovery and handling of such oil. The present invention further relates to methods for applying radiofrequency energy to heavy oils in the reservoir to promote in situ upgrading to facilitate recovery. This invention also relates to systems to apply radiofrequency energy to heavy oils in situ.

BACKGROUND OF THE INVENTION

Heavy crude oil presents problems in oil recovery and production. Crude oils of low API gravity and crude oils having a high pour point present production problems both in and out of the reservoir. Extracting and refining such oils is difficult and expensive. In particular, it is difficult to pump heavy crude oil or move it via pipelines.

Recovery of heavy crude oils may be enhanced by heating the oil in situ to reduce its viscosity and assist in its movement. The most commonly used process today for enhanced oil recovery is steam injection, where the steam condensation increases the oil temperature and reduces its viscosity. Steam in the temperature range of 150 to 300 degrees Fahrenheit may decrease the heavy oil viscosity by several orders of magnitude. Cyclic steam simulation (CCS) is a method that consists of injecting steam into a well for a period of time and then returning the well to production. A recently developed commercial process for heavy oil recovery is steam assisted gravity drainage (SAGD), which finds its use in high permeability reservoirs such as those encountered in the oil sands of Western Canada. SAGD has resulted recovery of up to 65% of the original oil in places, but requires water processing. All such methods tend to be expensive and require the use of external water sources.

Other methods in current use do not require the use of water or steam. For example, processes such as the Vapex process, which uses propane gas, and naphtha assisted gravity drainage (NAGD) use solvents to assist in the recovery of heavy crude oils. The drawback to these processes is that the solvents—propane or naphtha—are high value products and must be fully recovered at the end of the process for it to be economical.

Yet another potential method to enhance the recovery of heavy crude oils is the Toe-To-Heel Injection (THAI) process proposed by the University of Bath. THAI involves both vertical wells and a pair of horizontal wells similar to that used in the SAGD configuration, and uses combustion as the thermal source. Thermal cracking of heavy oil in the porous media is realized, and the high temperature in the mobile oil zone provides efficient thermal sweeping of the lighter oil to the production well.

Even when they are recovered, heavy crude oils present problems in refinement. Heavy and light crude oil processing will give the same range of refined products but in very different proportions and quantities. Heavy oils give much more vacuum residues than lighter oils. These residues have an API between one and five and very high sulfur and metals content, which makes treatment difficult. Several processes exist to convert vacuum residues. They are thermal, catalytic, chemical, or combinations of these methods. Thermal processes include visbreaking, aquathermolysis and coking.

Solvent deasphalting (SDA) is a proven process which separates vacuum residues into low metal/carbon deasphalted oil and a heavy pitch containing most of the contaminants, especially metals. Various types of hydrotreating processes have been developed as well. The principle is to lower the carbon to hydrogen ratio by adding hydrogen, catalysis such as tetralin. The goal is to desulfurize and remove nitrogen and heavy metals. These processes may require temperature control, pressure control, and some form of reactor technology such as fixed bed, ebullated bed, or slurry reactor.

Recent concepts associate different processes to optimize the heavy crude conversion. For example, the combination of hydrotreating and solvent deasphalting in refineries or on site for partial upgrading of heavy crude may be used.

Finally, the process of gasification for upgrading heavy oil is used. It consists of conversion by partial oxidation of feed, liquid, or solid into synthesis gas in which the major components are hydrogen and carbon monoxide.

There is a need for an apparatus and method to enhance the recovery of heavy crude oils that does not suffer from the drawbacks associated with current methods. In particular, there is a need for a method that does not use steam or water from external sources, solvents that must be recovered, or combustion. Ideally, such an apparatus and method would at the same time assist in the in situ refinement of the heavy oil.

The present invention provides just such a method and apparatus. It utilizes radiofrequency energy to combine enhanced oil recovery with physical upgrading of the heavy oil.

BRIEF SUMMARY OF THE INVENTION

The present invention provides a system and method to apply radiofrequency energy to in-situ heavy crude oil to heat the oil and other materials in its vicinity. This system and method enhance the recovery of the heavy crude oil. At the same time, it may be used to upgrade the heavy crude oil in situ.

This system enhances the recovery of oil through a thermal method. Heavy crude oils have high viscosities and pour points, making them difficult to recover and transport. Heating the oil, however, lowers the viscosity, pour point, and specific gravity of the oil, rendering it easier to recover and handle. Thus, in the present invention, directed radiofrequency radiation and absorption are used to heat heavy oil and reduce its viscosity, thus enhancing recovery. This dielectric heating also tends to generate fissures and controlled fracture zones in the formation for enhanced permeability and improved flow recovery of fluids and gases.

The system of the present invention is an in-situ radiofrequency reactor (RFR) to apply radiofrequency energy to heavy crude oil in situ. The RFR incorporates an in-situ configuration of horizontal and vertical wells in a heavy crude oil field. Using these wells, the RFR creates a subterranean reactor for the optimum production and surface recovery of the heavy crude oil. The RFR will provide an oil/hydrocarbon vapor front that will optimize recovery of the oil.

In it simplest form, the RFR may consist of two wells in the oil field, one a radiofrequency well and the second an oil/gas producing well. At least a portion of both wells are horizontal in the oil field, and the horizontal portion of the radiofrequency well is above the horizontal portion of the oil/gas producing well. A radiofrequency transmission line and antenna are placed in the horizontal radiofrequency well and used to apply radiofrequency energy to the oil, thereby heating it. The resulting reduction in the viscosity of the oil and mild cracking of the oil causes the oil to drain due to gravity. It is then recovered through the horizontal oil/gas producing well. Naturally, any number of radiofrequency and oil/gas producing wells can be used to create an RFR for the recovery of heavy crude oils.

The invention also has the capability of further enhancing recovery through the directed upgrading of the heavy oil in situ. The horizontal radiofrequency well may be strongly electromagnetically coupled to the horizontal oil/gas producing well so that the temperature of the horizontal oil/gas producing well may be precisely controlled, thereby allowing for upgrading of the heavy oil in the producing well over a wide range of temperatures. The oil/gas producing well may be embedded in a fixed bed of material, such as a catalyst bed, selected to provide upgrading of the crude oil draining from above. The upgrading can be based on several different known technologies, such as visbreaking, coking, aquathermolysis, or catalytic bed reactor technology.

The present invention has several promising advantages over present methods used to enhance recovery of heavy oil. In particular, the RFR does not require the use of water from external sources. This reduces expense and makes the recovery more economical and efficient. Furthermore, the present invention does not require the use of expensive solvents. Through the use of the present invention, enhanced recovery of heavy crude oil can be achieved more efficiently and cost-effectively.

Furthermore, in situ processing of crude oil has several advantages over conventional oil surface upgrading technology. First, in situ upgrading can be applied on a well to well basis, so that large volumes of production needed for surface processes are not required. Large, costly pressure vessels are not required since the reservoir formation serves as a reactor vessel. It can be applied in remote locations where a surface refinery would be inappropriate. Some of the required gases and possibly water can be generated in situ by the radiofrequency energy absorption. Finally, full range whole crude oils are treated by RFR and not specific boiling range fractions as is commonly done in refineries. This is made possible by the ability of radiofrequency absorption to provide precise temperature control throughout the reactor volume. The proposed reactor provides large quantities of heat through radiofrequency absorption close to the production well where the catalyst bed is placed. No heat carrying fluids are necessary with radiofrequency heating.

In one embodiment of the invention, an in situ radiofrequency reactor for use in thermally recovering oil and related materials may be provided. The reactor may comprise at least one radiofrequency heating well in an area in which crude oil exists in the ground, a radiofrequency antenna positioned within each radiofrequency heating well in the vicinity of the crude oil, a cable attached to each radiofrequency antenna to supply radiofrequency energy to such radiofrequency antenna, a radiofrequency generator attached to the cables to generate radiofrequency energy to be supplied to each radiofrequency antenna, and at least one production well in proximity to and below the radiofrequency wells for the collection and recovery of crude oil.

In another embodiment of the invention, an in situ radiofrequency reactor for use in thermally recovering oil and related materials and refining heavy crude oil in situ may be provided. The reactor may comprise at least one radiofrequency heating well in an area in which crude oil exists in the ground, a radiofrequency antenna positioned within each radiofrequency heating well in the vicinity of the crude oil, a cable attached to each radiofrequency antenna to supply radiofrequency energy to such radiofrequency antenna, a radiofrequency generator attached to the cables to generate radiofrequency energy to be supplied to each radiofrequency antenna, at least one production well in proximity to and below the radiofrequency wells and coupled magnetically to the radiofrequency wells for the collection and recovery of crude oil, and at least one catalytic bed in which the production well is embedded.

In yet another embodiment of the invention, a method for recovering heavy crude oil is provided. The method comprises the steps of positioning a radiofrequency antenna in a well in the vicinity of heavy crude oil, generating radiofrequency energy, applying the radiofrequency energy to the heavy crude oil with the radiofrequency antenna to heat the oil, and recovering the heavy crude oil through production well.

In one aspect, in general, a radiofrequency reactor for use in thermally recovering oil and related materials. The radiofrequency reactor includes a radiofrequency antenna configured to be positioned within a well, where the well is provided within an area in which crude oil exists in the ground. The radiofrequency antenna includes a cylindrically-shaped radiating element for radiating radiofrequency energy into the area in which crude oil exists. The cylindrically-shaped radiating element is configured to allow passage of fluids there through. The radiofrequency reactor also includes a radiofrequency generator electrically coupled to the radiofrequency antenna. The radiofrequency reactor is operable to control the radiofrequency energy generated.

Aspects may include one or more of the following.

The cylindrically-shaped radiating element in the radiofrequency reactor includes a plurality of apertures for allowing passage of the fluids. In some examples, the plurality of apertures have dimensions selected on the basis of the frequency of the radiofrequency energy.

The radiofrequency reactor includes a coaxial cable for coupling the radiofrequency antenna to the radiofrequency generator.

The radiofrequency reactor includes a choke assembly positioned between the radiofrequency antenna and radiofrequency generator to maximize transmission of the radiofrequency energy to the radiofrequency antenna. In some examples, the choke assembly includes an inner conductive casing surrounded by a dielectric portion, the assembly running at least one-quarter of a maximal frequency to be emitted, and the inner casing is connected to a cable for coupling the radiofrequency antenna to the radiofrequency generator.

The radiofrequency reactor may be one of a plurality of reactors. In such a situation, the radiofrequency generator of each reactor is operable to control the radiofrequency energy generated and is configured to work in conjunction with the radiofrequency generators of the plurality of reactors.

The radiofrequency generator operable to control the radiofrequency energy generated is configured to control the phase of the radiofrequency energy emitted.

In another aspect, in general, a method of retrofitting an oil well for extracting crude oil. The method includes electrically coupling a radiofrequency generator to a radiofrequency antenna, where the radiofrequency antenna includes a cylindrically-shaped radiating element for radiating radiofrequency energy into the crude oil. The method also includes controlling the radiofrequency generator to provide radiofrequency energy to the radiofrequency antenna.

Aspects may include one or more of the following.

Positioning the radiofrequency generator proximally to the well surface and electrically coupling the radiofrequency generator to the cylindrically-shaped radiating element via a coaxial cable.

Connecting a choke assembly between the radiofrequency generator and the cylindrically-shaped radiating element.

Controlling the radiofrequency generator to provide radiofrequency energy to the radiofrequency antenna, including controlling the phasing of the radiofrequency energy emitted.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

A variety of different arrangements of wells and antennae may be employed to apply radiofrequency energy to heavy crude oil in situ, thereby enhancing oil recovery and achieving in situ upgrading of the oil. The proper structure and arrangement for any particular application depends on a variety of factors, including size of field, depth, uniformity, and nature and amount of water and gases in the field.

Figure 1:
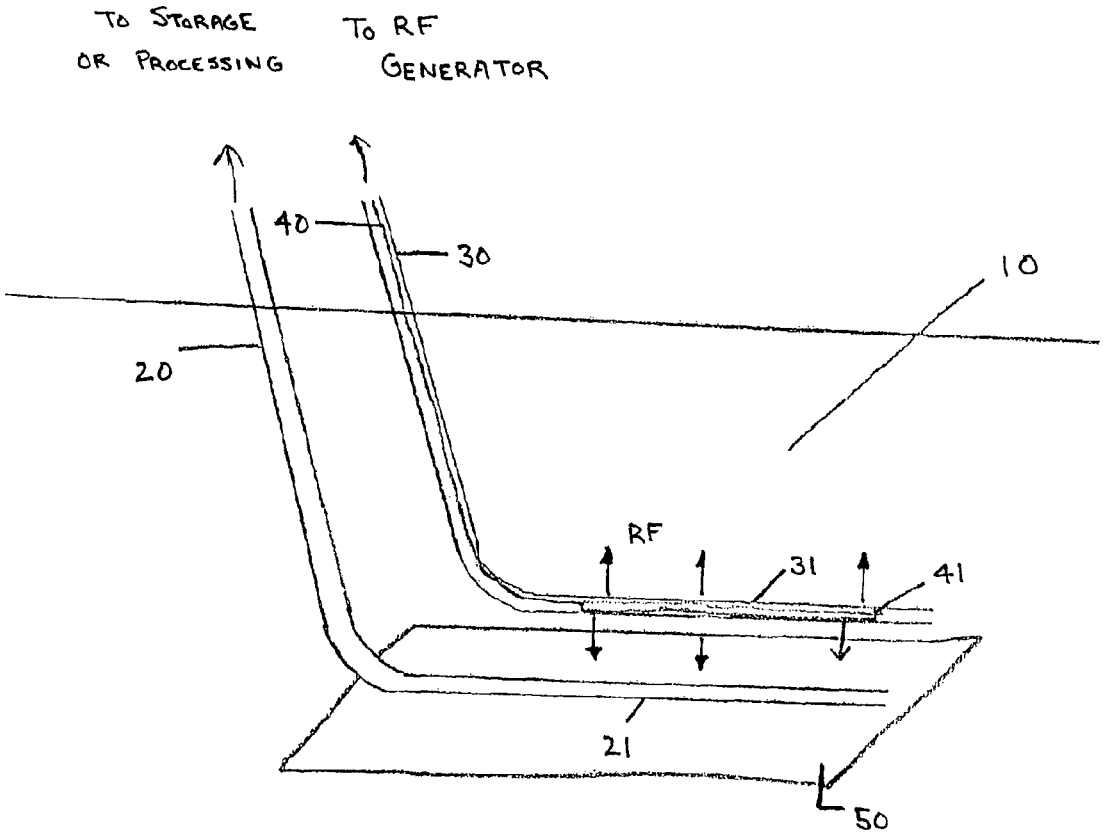
FIG. 1 is a perspective view of a basic in situ radiofrequency reactor.

FIG. 1 is a perspective view of a basic in situ radiofrequency reactor. Heavy oil is present in oil field 10. Oil/gas production well 20 is drilled into the oil field for recovery of heavy oil and other materials. At least a portion of oil/gas production well 20 is drilled horizontally through the oil field. Horizontal oil/gas production well 21 is positioned to receive oil and other gas that are moved or generated by the action of the radiofrequency reactor. A second well, radiofrequency well 30, is drilled into the oil field in proximity to oil/gas production well 20. At least a portion of radiofrequency well 30 is drilled horizontally through the oil field in proximity to and above horizontal oil/gas production well 21. Horizontal radiofrequency well 31 is used to apply radiofrequency energy to the surrounding heavy crude oil field, thereby heating the oil and reducing its viscosity. Due to gravity, the reduced heated heavy crude oil drains, where it may be captured by and pumped out through oil/gas production well 20 to storage or processing equipment.

Radiofrequency energy is generated by a radiofrequency generator. It is transmitted via radiofrequency transmission line 40 through radiofrequency well 30 and horizontal radiofrequency well 31 to radiofrequency antenna 41. Radiofrequency antenna 41 applies radiofrequency energy to the surrounding heavy crude oil, thereby heating it and reducing its viscosity so that it may be collected by and recovered through oil/gas production well 20. The oil/gas production well 20 may also act as a parasitic antenna to redirect radiation in an upward direction toward the formation to be heated by the radiofrequency energy, thereby increasing efficiency.

For purposes of in situ processing and upgrading of the heavy crude oil, horizontal oil/gas production well 21 may be embedded in catalytic bed 50. Horizontal radiofrequency well 31 may be strongly electromagnetically coupled to horizontal oil/gas producing well 21 so that the temperature of horizontal oil/gas producing well 21 may be precisely controlled, thereby allowing for upgrading of the heavy oil in horizontal oil/gas production well 21 over a wide range of temperatures. The upgrading can be based on several different known technologies, such as visbreaking, coking, aquathermolysis, or catalytic bed reactor technology.

Figure 2:
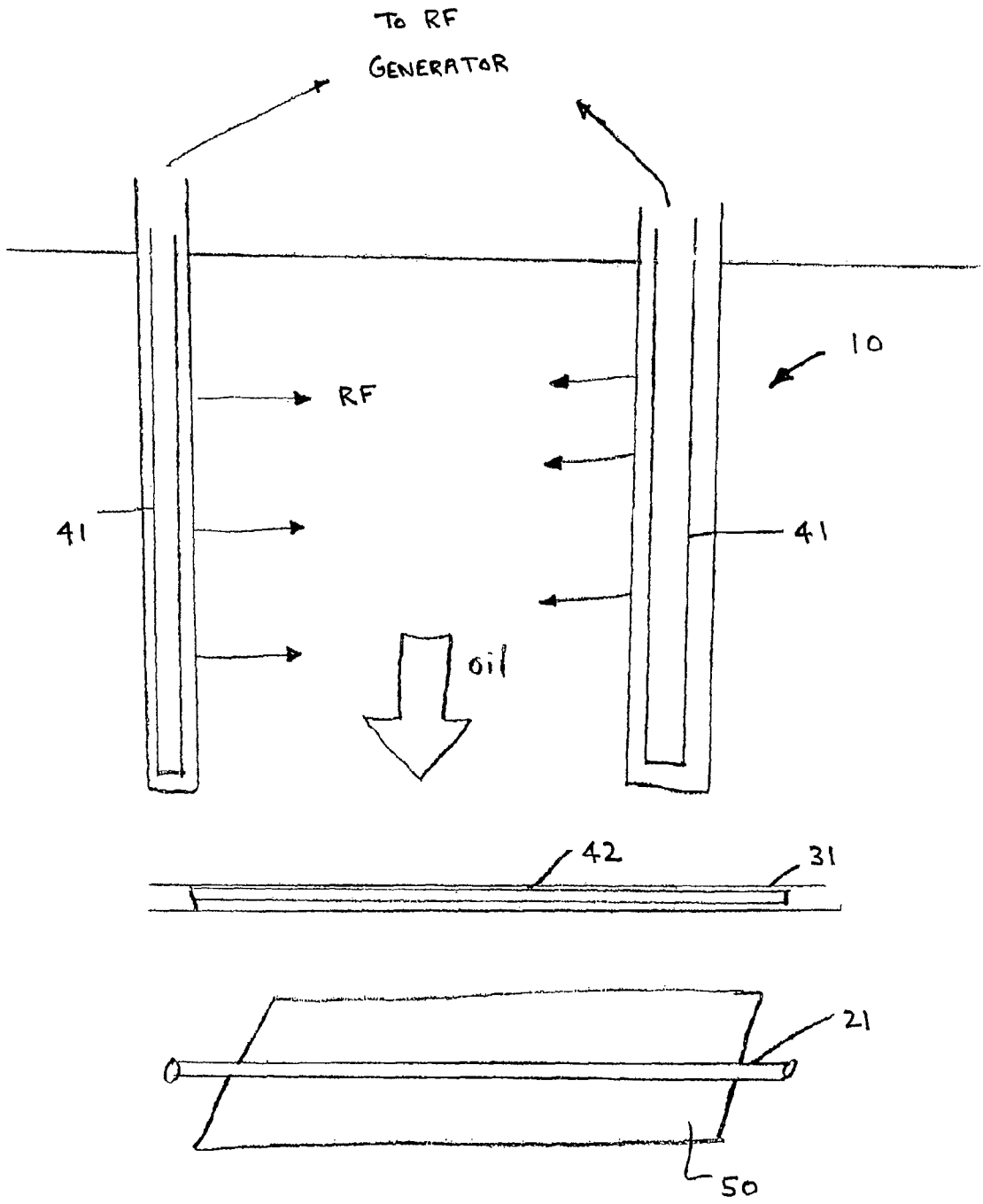
FIG. 2 is a perspective view of an alternative arrangement of an in situ radiofrequency reactor.

Radiofrequency antennae may be placed in an oil field in numerous configurations to maximize oil recovery and efficiency. FIG. 2 shows a perspective view of an alternative arrangement of an in situ radiofrequency reactor. Radiofrequency antennae 41 may be placed in proximity to one another in oil field 10. Radiofrequency energy is supplied to the antennae 41 by a radiofrequency generator and then applied to the oil field 10. The resulting heating reduces the viscosity of the oil, which drains due to gravity. Horizontal oil/gas production well 21 is positioned below the antennae 41 to collect and recover the heated oil.

As with the RFR in FIG. 1, this arrangement may also be used to process the heavy oil in situ. A horizontal radiofrequency well 31 with horizontal radiofrequency antenna 42 may be placed in proximity to horizontal oil/gas producing well 21 below antennae 41 to control the temperature of the oil. Horizontal oil/gas production well 21 may be embedded in catalytic bed reactor 50. The oil may thereby be upgraded in situ.

Figure 3:
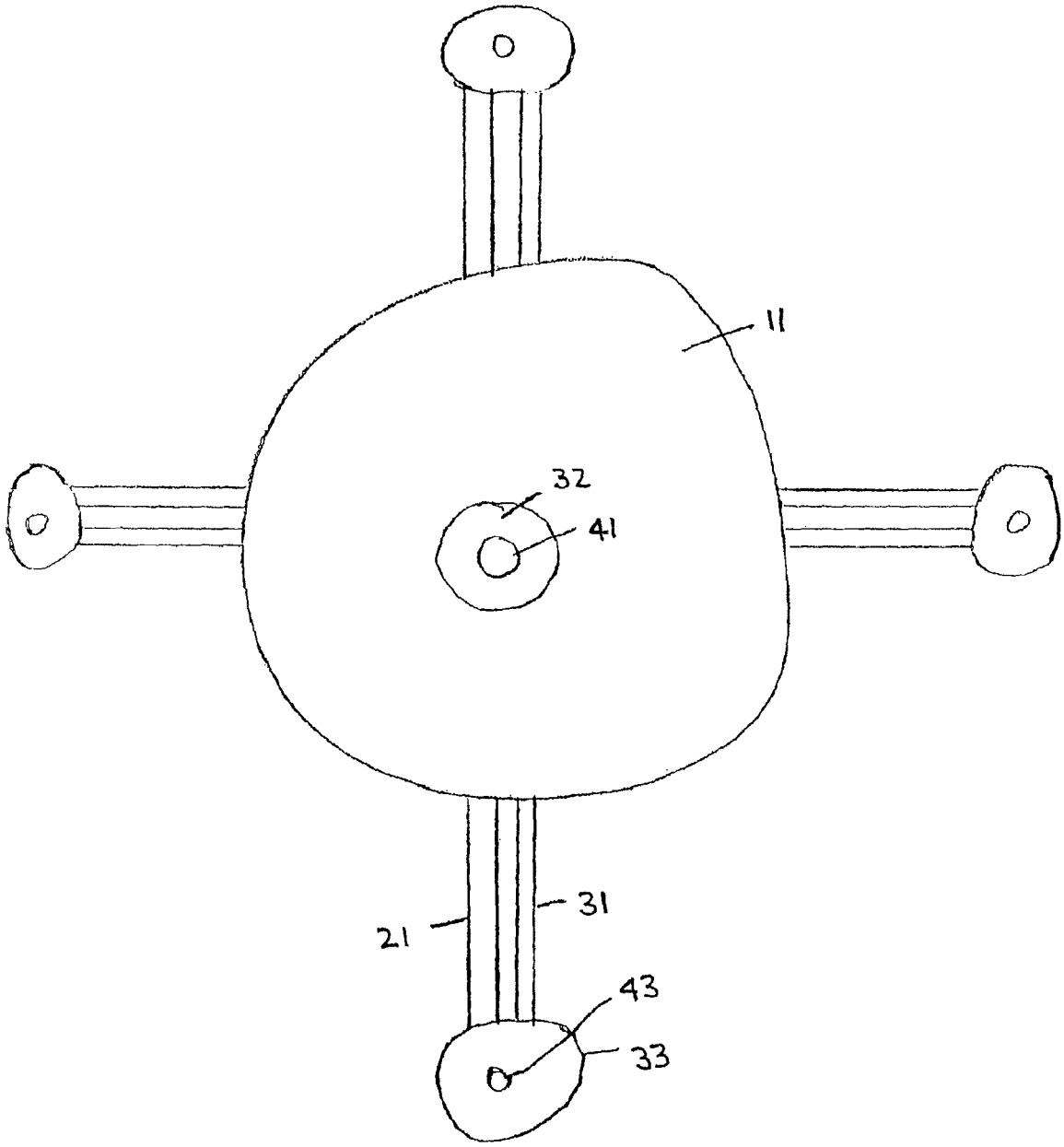
FIG. 3 is a top view of an arrangement for an in situ radiofrequency reactor for use in large oil fields.

FIG. 3 shows a top view of another arrangement for an in situ radiofrequency reactor for use in large oil fields. In this radial configuration, one central and vertical radiofrequency heating well 32 with radiofrequency antenna 41 is used for larger volumes of oil. Radiofrequency antenna 41 applies radiofrequency energy to area 11, thereby heating the oil in that area. The heated oil drains to horizontal oil/gas production wells 21 for collection and recovery. Parallel horizontal radiofrequency wells 31 may also be used to heat the oil. In addition, radiofrequency antennae 43 may be placed in vertical radiofrequency wells 33 to assist with in situ upgrading of the heavy crude oil.

Figure 4:
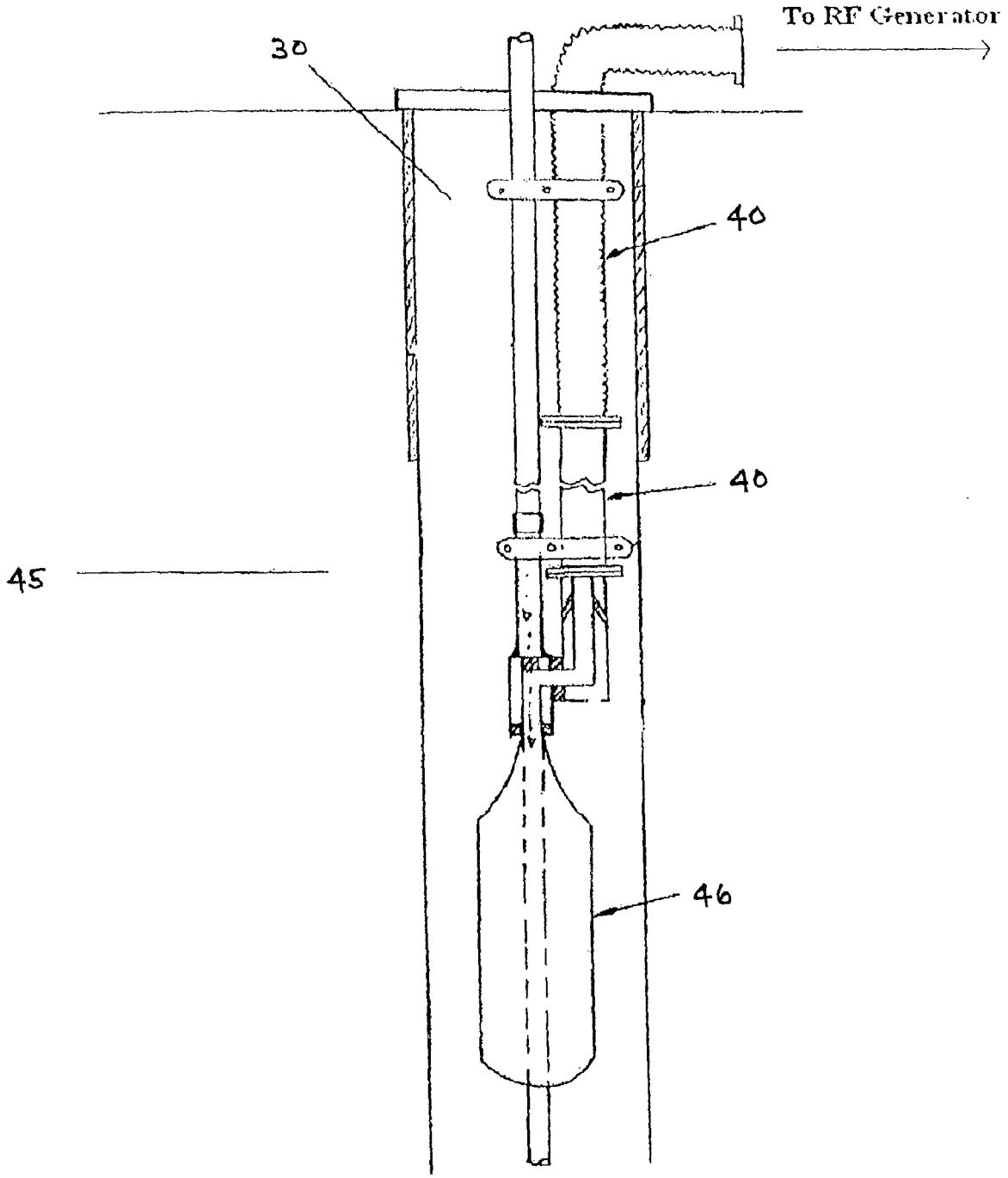
FIG. 4 is a perspective view of a single borehole radiation type applicator that may be used in the radiofrequency reactor of the present invention.

The radiofrequency antennae used in the RFR system of the present invention may be any of those known in the art. FIG. 4 shows a perspective view of a radiofrequency applicator that may be used with the RFR of the invention. Applicator system 45 is positioned within radiofrequency well 30.

Applicator system 45 is then used to apply electromagnetic energy to heavy crude oil in the vicinity of radiofrequency well 30.

Applicator structure 46 is a transmission line retort. Radiofrequency energy is supplied to applicator 46 by an RF generator (not shown). The radiofrequency generator is connected to applicator 46 via radiofrequency transmission line 40. The radiofrequency transmission line 40 may or may not be supported by ceramic beads, which are desirable at higher temperatures. By this means, the radiofrequency generator supplies radiofrequency energy to applicator 46, which in turn applies radiofrequency energy to the target volume of oil.

Although one specific examples of an applicator structure is given, it is understood that other arrangements known in the art could be used as well. Uniform heating may be achieved using antenna array techniques, such as those disclosed in U.S. Pat. No. 5,065,819.

The present invention also has application in oil shale fields, such as those present in the Western United States. Large oil molecules that exist in such oil shale have been heated in a series of experiments to evaluate the dielectric frequency response with temperature. The response at low temperatures is always dictated by the connate water until this water is removed as a vapor. Following the water vapor state, the minerals control the degree of energy absorption until temperatures of about 300-350 degrees centigrade are reached. In this temperature range, the radiofrequency energy begins to be preferentially absorbed by the heavy oil. The onset of this selective absorption is rapid and requires power control to insure that excessive temperatures with attendant coking do not occur.

Because of the high temperature selective energy absorption capability of heavy oil, it is therefore possible to very carefully control the bulk temperature of crude oil heated by radiofrequency energy. The energy requirement is minimized once the connate water is removed by steaming. It takes much less energy to reach mild cracking temperatures with radiofrequency energy than any other thermal means.

Kasevich has published a molecular theory that relates to the specific heating of heavy of oil molecules. He found that by comparing cable insulating oils with kerogen (oil) from oil shale, a statistical distribution of relaxation times in the kerogen dielectric gave the best theoretical description of how radiofrequency energy is absorbed in oil through dielectric properties. With higher temperatures and lowering of potential energy barriers within the molecular complex a rapid rise in selective energy absorption occurs.

In use, a user of an embodiment of the present invention would drill oil/gas production wells and radiofrequency wells into a heavy crude oil field. At least a portion of the wells would be horizontal. The radiofrequency wells would be placed in proximity to and above the oil/gas production wells. The user would install a radiofrequency antenna in each radiofrequency well and supply such antennae with radiofrequency energy from a radiofrequency generator via a radiofrequency transmission cable. The user would then apply radiofrequency energy using the radiofrequency generator to the antenna, thereby applying the radiofrequency energy to the heavy crude oil in situ. The radiofrequency energy would be controlled to minimize coking and achieve the desired cracking and upgrading of the heavy crude oil. The resulting products would then be recovered via the oil/gas production well and transferred to a storage or processing facility.

Referring again to FIG. 4, the applicator structure 46 is a vertical monopole antenna within a non-metallic production pipe (shown as a radiofrequency well 30). The production pipe extension below the applicator or antenna may be used to enhance the radiation efficiency by adjusting the length of the pipe. The pipe may extend into or below the subterranean oil or gas.

Figure 5:
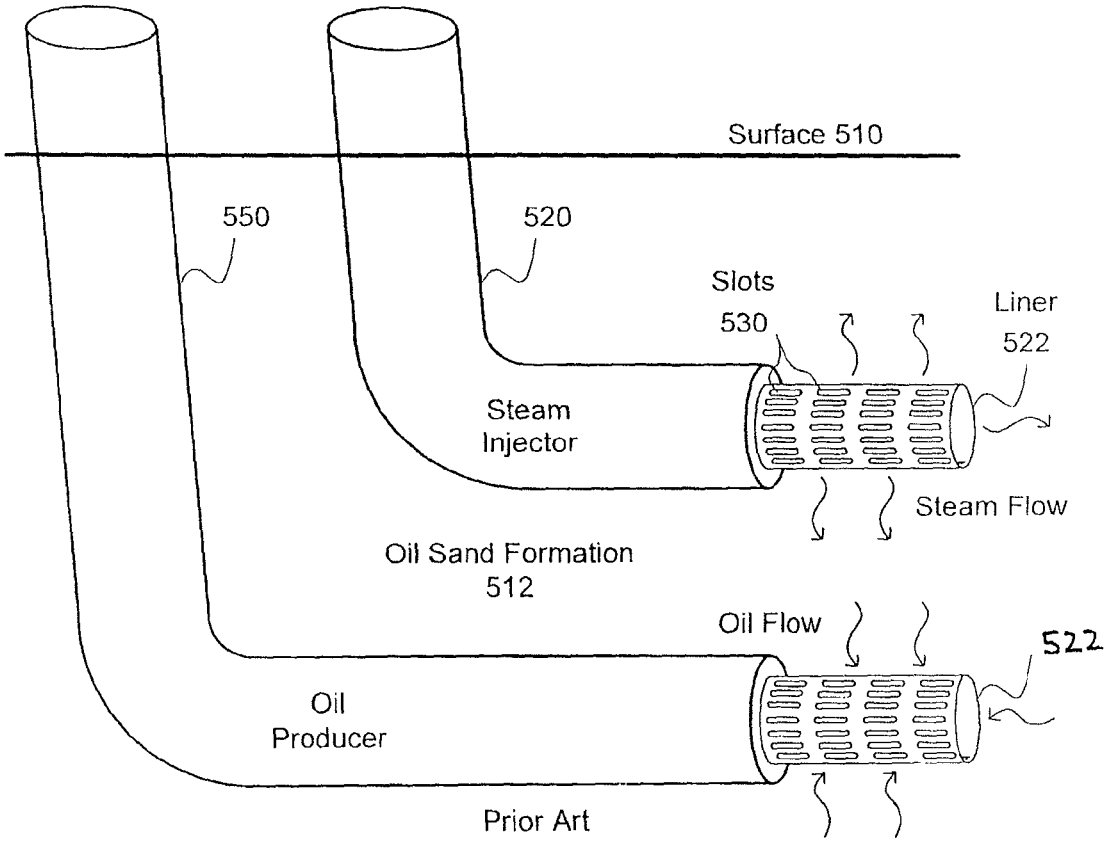
FIG. 5 is a diagram of a prior art steam assisted gravity drainage (SAGD) system.

As described in the above background section, steam assisted gravity drainage (SAGD), is an existing commercial process for heavy oil recovery, used especially in high permeability reservoirs such as those encountered in the oil sands of Western Canada. Referring to FIG. 5, in the SAGD process, two parallel horizontal oil wells 520 & 550 are drilled in the formation, one above the other (in some examples, roughly 10 meters apart). The upper well acts as a steam injector 520 and typically includes a slotted liner 522 (in some examples, roughly 300 meters long) for allowing steam to be released through the slots 530. The steam increases the temperature of the crude oil in the oil sand formation 512, reducing the crude oil's viscosity and allowing it to be collected by gravity drainage via the lower well, referred to as an oil producer 550. The slotted liner 522 is typically made of conductive materials.

Figure 6:
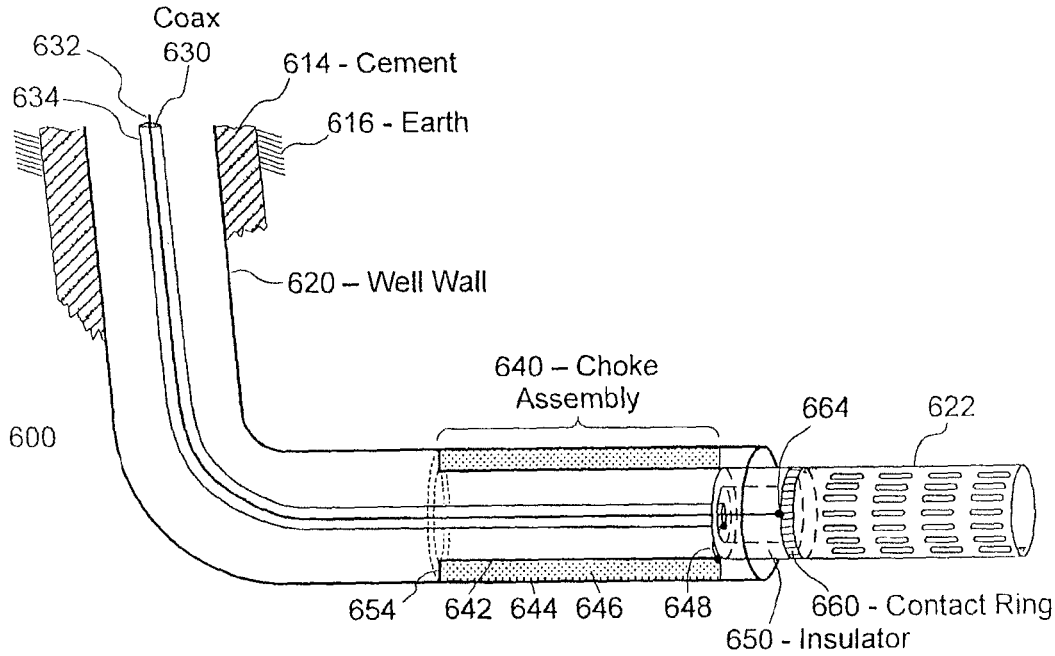
FIG. 6 is a diagram of a well retrofitted as an in situ radiofrequency reactor.

Referring to FIG. 6, in some embodiments, the SAGD configuration is retrofitted to use one or both wells (or portions thereof, e.g., the liners) as an antenna for emitting RF energy into the oil sand formation. The RF energy increases the temperature of the crude oil, reducing its viscosity and allowing it to be collected. In some embodiments the oil is collected using a pipe (not shown) within the same well as the well 600 configured to host an antenna.

A coaxial cable 630 connects a power source (not shown), for example, a radiofrequency generator stationed on the surface, to the slotted liner 622. The coaxial cable 630 has a central conductor 632 surrounded by a dielectric insulating portion and an outer conductive shield 634. In some embodiments, the outer conductor 634 is also wrapped in an external insulating layer.

At the distal end of the well, the coaxial cable's central conductor 632 is electrically connected to the well's slotted liner 622. In some embodiments, the connection to the liner 622 is achieved using a metal contact ring 660 to which the central conductor 632 is electrically connected 664 (e.g., welded). The contact ring 660 is mated with the liner 622.

In some embodiments, an insulating section 650 is used, for example, to separate the slotted liner 622 from the well wall 620. The insulating section 650 is a hollow cylinder that allows the coaxial cable 630 and any other cables or pipes (e.g., an oil collection pipe) to pass through it. In some examples, the insulating section 650 is ceramic.

As shown if FIG. 6, the well 600 is supported in the earth 616 by a cement casing 614. The cement 614 is susceptible to cracking if subjected to excessive heat. In such embodiments, it may be desirable to restrict the level of RF energy returning up the well 600, for example, to reduce the risk of the cement 614 cracking. Therefore, a high impedance block is created.

In the embodiment shown in FIG. 6, the outer conductor 634 of the coaxial cable 630 is electrically connected 648 to a quarter-wave choke assembly 640. The optimal length of the choke assembly is an odd multiple of quarter-wavelengths (¼, ¾, ⅝, etc.). That is, the choke assembly 640 extends back from the insulator 650 at least one quarter of the maximum wavelength for the energy to be emitted from the antenna. The choke assembly 640 may extend further back, in some examples, extending all of the way back to the surface.

The quarter-wave choke assembly 640 includes an inner conductor 642, which is separated from either the well wall 620 or an outer assembly casing 644 by either air or a dielectric layer 646. The outer conductor 634 of the coaxial cable 630 is electrically connected 648 to the inner conductor 642 of the choke assembly 640. The inner conductor 642 is shorted 654 to the inner side of the well wall 620 at the proximal end of the choke assembly 640.

The quarter-wave choke assembly 640 creates a high impedance block restricting the flow of energy back up the well 600. Alternatively, in some embodiments, the outer conductor 634 is electrically connected directly to the inside of the well wall 620.

Referring again to FIG. 5, in certain embodiments, multiple wells (e.g., both the steam injector 520 and the oil producer 550) are retrofitted as RF antennas. In such embodiments, the multiple antennas are powered in a manner to boost the RF energy, for example, by emitting energy in phase. In other embodiments, the phase of the energy emitted by each of the multiple antennas can be tuned to control the energy levels within the oil sand formation by controlling the antennas to emit out of phase.

Figure 7:
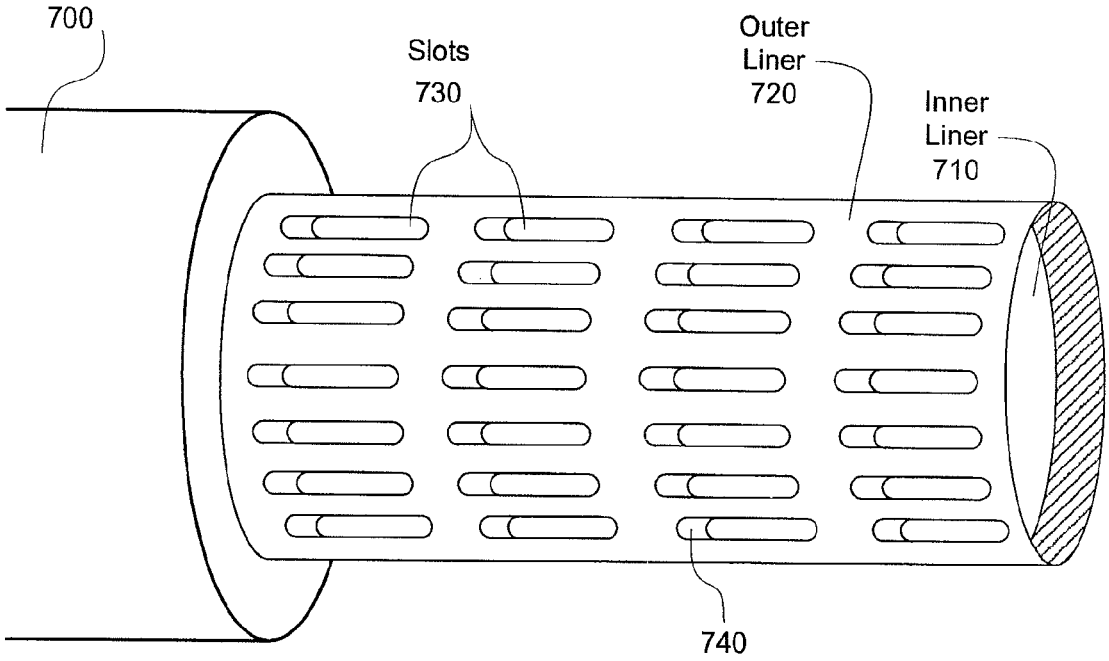
FIG. 7 is a diagram of a slotted liner protruding from a well shaft.

In certain applications, the slots in the slotted liner are sized in a manner to increase the efficacy of subsequent RF retrofit. Referring to FIG. 7, in some embodiments, a well 700 is configured with two slotted liners—an inner liner 710 and an outer liner 720. Each liner includes slots 730. At least one liner, e.g., the inner liner 710, is configured to be adjusted, acting as a telescoping sleeve. By telescoping the liner, the size of the slots 730 are adjusted. The liner overlap 740 therefore creates variably sized slots. Using this approach, the slots in the slotted liner are dynamically sized as needed.

In some embodiments, the presence of the RF retrofit does not preclude the contemporary use of steam or other oil recovery methods. For example, the RF energy is used to initiate the process of oil recovery by alternative means.

Although the present invention has been described with reference to preferred embodiments, persons skilled in the art will recognize that changes may be made in form and detail without departing from the spirit and scope of the invention.

What is claimed is:

1. A radiofrequency reactor for use in thermally recovering oil and related materials, the reactor comprising:

a radiofrequency antenna configured to be positioned within a well provided within an area in which crude oil exists in the ground, the radiofrequency antenna including a cylindrically-shaped radiating element for radiating radiofrequency energy into the area in which crude oil exists, the cylindrically-shaped radiating element configured to allow passage of fluids there through; and a radiofrequency generator electrically coupled to the radiofrequency antenna and operable to control the radiofrequency energy generated, wherein the cylindrically-shaped radiating element includes a plurality of apertures for allowing passage of the fluids, the apertures being adjustable in size, the cylindrically-shaped radiating element including an inner cylindrical liner coaxially arranged with an outer cylindrical liner, each cylindrical liner including a plurality of apertures for allowing passage of the fluids, the position of one of the inner and outer liners being axially adjustable relative to the other of the inner and outer liners whereby modulation of emitted energy is achieved.

2. The radiofrequency reactor of claim 1 wherein the plurality of apertures have dimensions selected on the basis of the frequency of the radiofrequency energy.

3. The radiofrequency reactor of claim 1 further comprising a coaxial cable for coupling the radiofrequency antenna to the radiofrequency generator.

4. The radiofrequency reactor of claim 1, further comprising a choke assembly positioned between the radiofrequency antenna and radiofrequency generator to maximize transmission of the radiofrequency energy to the radiofrequency antenna.

5. The radiofrequency reactor of claim 4, wherein the choke assembly includes an inner conductive casing surrounded by a dielectric portion, the assembly running at least one-quarter of a maximal frequency to be emitted, and the inner casing electrically coupled to the radiofrequency generator and to the inside of the well wall.

6. The radiofrequency reactor of claim 5, wherein the assembly runs an odd-multiple of one-quarter of a maximal frequency to be emitted.

7. The radiofrequency reactor of claim 1, wherein the reactor is one in a plurality of reactors and the radiofrequency generator operable to control the radiofrequency energy generated is configured to work in conjunction with the radiofrequency generators of the plurality.

8. The radiofrequency reactor of claim 1, wherein the radiofrequency generator operable to control the radiofrequency energy generated is configured to control the phase of the radiofrequency energy emitted.

9. A method of retrofitting an oil well for extracting crude oil, the method comprising:

electrically coupling a radiofrequency generator to a radiofrequency antenna including a cylindrically-shaped radiating element for radiating radiofrequency energy into the crude oil, the cylindrically-shaped radiating element including an inner cylindrical liner coaxially arranged with an outer cylindrical liner, each cylindrical liner including a plurality of apertures for allowing passage of the fluids, the position of one of the inner and outer liners being axially adjustable relative to the other of the inner and outer liners, the apertures being adjustable in size; and controlling the radiofrequency generator to provide radiofrequency energy to the radiofrequency antenna.

10. The method of claim 9, further comprising positioning the radiofrequency generator proximally to the well surface and electrically coupling the radiofrequency generator to the cylindrically-shaped radiating element via a coaxial cable.

11. The method of claim 10, further comprising connecting a choke assembly between the radiofrequency generator and the cylindrically-shaped radiating element.

12. The method of claim 9, wherein controlling the radiofrequency generator to provide radiofrequency energy to the radiofrequency antenna comprises controlling the phasing of the radiofrequency energy emitted.

13. The method of claim 9, further comprising adjusting the aperture size to modulate emitted energy.

14. A radiofrequency reactor system for use in thermally recovering oil and related materials, the reactor system comprising:

a radiofrequency reactor including:

a radiofrequency antenna configured to be positioned within a radiofrequency well provided within an area in which crude oil exists in the ground, the radiofrequency antenna including a cylindrically-shaped radiating element for radiating radiofrequency energy into the area in which crude oil exists, the cylindrically-shaped radiating element configured to allow passage of fluids there through, the cylindrically-shaped radiating element including an inner cylindrical liner coaxially arranged with an outer cylindrical liner, each cylindrical liner including a plurality of apertures for allowing passage of the fluids, the position of one of the inner and outer liners being axially adjustable relative to the other of the inner and outer liners; and a radiofrequency generator electrically coupled to the radiofrequency antenna and operable to control the radiofrequency energy generated, and an oil well provided within the area at a location below the radiofrequency well, the oil well configured to receive radiofrequency-energized crude oil.

* * * * *